United States Patent [19]

Norris

[11] Patent Number: 4,612,598

[45] Date of Patent: Sep. 16, 1986

[54] ELECTROSTATIC SPRAYING APPARATUS

[75] Inventor: Alan J. Norris, Cleveland, England

[73] Assignee: Imperial Chemical Industries, PLC, London, England

[21] Appl. No.: 722,388

[22] Filed: Apr. 12, 1985

[30] Foreign Application Priority Data

Apr. 25, 1984 [GB] United Kingdom ..... 8410520

[51] Int. Cl.[4] ..... B05B 5/02

[52] U.S. Cl. ..... 361/227; 361/228

[58] Field of Search ..... 361/226–228; 251/80, 83, 236, 243, 294, 321

[56] References Cited

U.S. PATENT DOCUMENTS 3,273,015 9/1966 Fischer ..... 361/227
4,356,528 10/1982 Coffee ..... 361/226
4,476,515 10/1984 Coffee ..... 361/226
4,549,243 10/1985 Owen et al. ..... 361/228
4,561,037 12/1985 MacLaine et al. ..... 361/228

FOREIGN PATENT DOCUMENTS 1598501 9/1981 United Kingdom .

*Primary Examiner*—L. T. Hix
*Assistant Examiner*—D. Rutledge
*Attorney, Agent, or Firm*—Cushman, Darby & Cushman

[57] ABSTRACT

Electrostatic spraying apparatus wherein the liquid supply to the spray nozzle 20 is via a mechanical valve operated by an actuating member 12. Actuating member 12 is connected to a remote operating lever 3, which is preferably electrically conductive, via a connecting member 41 including an elastically extensible portion, e.g. a spring 39. Connecting member 41 is electrically conductive thus providing an electrical connection from lever 3 to the spray head.

9 Claims, 4 Drawing Figures

ELECTROSTATIC SPRAYING APPARATUS

This invention relates to an electrostatic spraying apparatus and in particular to such apparatus of the type wherein the spray is produced from a nozzle to which the liquid is supplied from a reservoir via a valve.

Electrostatic spraying apparatus, e.g. for spraying plants with pesticides, has been disclosed in, inter alia, U.S. Pat. No. 4,356,528. In such apparatus, when a high potential, relative to earth, is applied, directly or indirectly, to a nozzle through which the liquid to be sprayed is flowing, the liquid is drawn off from the nozzle as one or more ligaments which then break up into a spray of electrically charged droplets. It is desirable in such apparatus, to avoid wastage of the liquid being sprayed, that the supply of liquid to the nozzle from a reservoir is controlled by a valve so that the supply can be turned on and off as desired. Often it is desired to operate the valve from a position remote from the valve. Thus the apparatus may comprise an elongated shaft intended to be held at one end with the sprayhead including the nozzle, valve, and in many cases also the liquid reservoir, at the other end of the shaft. The handle end of the shaft thus desirably incorporates a manually operated lever, e.g. a trigger, to operate the valve. A mechanical connection is thus required between the lever and the valve to effect operation of the latter.

At the handle end of the shaft there will usually be means whereby the high voltage required for atomisation of the liquid can be switched on and off: if desired the switch contacts can be actuated by movement of the valve operating lever.

We have devised a particularly suitable form of construction which overcomes certain problems and further enables the apparatus to be simplified.

Accordingly the present invention provides electrostatic spraying apparatus incorporating (a) a sprayhead having (i) a nozzle from which the liquid is to be sprayed, (ii) liquid delivery means, incorporating a mechanically operable valve, for supplying liquid from a reservoir to the nozzle, (iii) a valve-actuating member arranged such that linear movement of at least a portion thereof causes said valve to operate, (iv) means for applying a high electric potential, relative to earth, to said nozzle, (b) a manually operable lever remote from said sprayhead, and (c) a mechanical connection between said lever and said valve-actuating member whereby movement of said lever causes the linear movement of said valveactuating member to effect operation of the valve, said mechanical connection comprising a connecting member anchored at one end to a fixed part of the sprayhead and at the other end engaging with said lever, said connecting member including an elastically extensible portion and said valve-actuating member engaging with said connecting member at a position within said elastically extensible portion, and said connecting member being electrically conductive thus providing an electrical connection from said lever to said sprayhead.

By being electrically conductive, the connecting member serves an auxiliary function to that of mechanical connection, viz the provision of an electrical connection from the lever to the sprayhead.

The connecting member incorporating an elastically extensible portion serves to act as a return spring so that the manually operable lever can be biassed, preferably to the "off" position without the need of a separate return spring associated with the lever assembly (although a separate return spring could be provided if desired). By engaging the valve-actuating member with the connecting member at a position within the elastically extensible portion two advantages accrue. Firstly the risk of damage to the valve, resulting from movement of the lever, e.g. as a result of usage by a heavy-handed operator, past that necessary to actuate the valve, is minimised since extension of that part of the extensible portion between the lever and that point of engagement of the connecting member with the valve-actuating member can accomodate such an excess of movement. Secondly because of the ability of accomodating an excess of movement without risk of damage to the valve, manufacturing tolerances are less critical and the need for post-assembly adjustment reduced or eliminated. Furthermore if, as is preferred, the lever is also arranged to act as a switch to cause the high voltage to the nozzle to be turned on and off, if desired the switch contacts can be positioned so that the valve does not open until after the switch contact "make" to apply the high voltage to the nozzle.

In a preferred form of the invention, the extensible portion of the connecting member comprises an open-coil tension spring. The valve-actuating member in such a case conveniently engages with the connecting member by means of a part, e.g. a blade, pin or peg, of the valve-actuating member passing between adjacent turns of the spring coil. It is seen that since the position of engagement of the valve-actuating member with the connecting member can be varied by positioning the engaging part of the valve-actuating member between different adjacent turns of the coil spring, this form of construction provides scope for simple adjustment during assembly to ensure that the valve operates over the desired range of movement of the lever.

In an alternative form of the invention, the connecting member has two tension springs in series and the valve-actuating member is engaged with the connecting member at a location between those two springs.

The connecting member, including the elastically extensible portion is made of an electrically conductive material, e.g. metal wire, to provide an electrical connection from the lever to the sprayhead. While it is preferred, for reasons described hereinafter, that the lever is electrically conductive, this is not necessarily so. In that case the connecting member can provide an electrical connection to the sprayhead from other components in the vicinity of the lever, an electrical connection between the connecting member and the requisite component being made via a suitable contact against which the connecting member slides or via a flexible lead fastened to the connecting member near to the lever.

In one form of the invention, the apparatus incorporates a battery powered high voltage generator located in or adjacent to the sprayhead with the batteries located at a position remote therefrom e.g. inside a handle incorporating the lever.

In such an arrangement the electrically conductive connecting member can be used as one of the connections required to provide power from the battery to the high voltage generator.

In another form of the invention, the high voltage generator is located remote from the sprayhead but in the vicinity of the lever. In this case, if the lever is made of an electrically insulating material, by providing a connection from the high voltage generator to the connecting member adjacent to the lever, the connecting member can be used as the high voltage lead from the generator to the sprayhead.

In a preferred form of the invention, disposed adjacent the nozzle, but insulated therefrom, is an electrically conductive member hereinafter termed a field adjusting electrode. As described in the aforementioned U.S. Pat. No. 4,356,528, when earthed, such an electrode acts to intensify the electrical field provided by the high voltage at the nozzle. In the preferred form of the invention, the lever is of an electrically conductive material and the connecting member provides an electrical connection from the lever to the field adjusting electrode so that when the lever is contacted by the operator's hand or finger, the field adjusting electrode is earthed via conduction through the operator's body.

Where the high voltage generator is of the type producing rectified high voltage pulses and is located in the vicinity of the lever, an earthed conductor, whether or not associated with a field adjusting electrode, may be desirable alongside but insulated from the high voltage lead from the generator to the sprayhead in order to provide sufficient capacitance in the high voltage circuit to permit the high voltage required for atomisation to be maintained at the nozzle between successive pulses. Such as earthed conductor may be provided by the connecting member.

Where the high voltage generator is located in the sprayhead and powered by batteries remote therefrom, the connecting member may provide not only one of the power connections from the batteries to the generator but also may provide the earth connection for a field adjusting electrode.

The invention is illustrated by reference to the accompanying drawings wherein.

Figure 1:
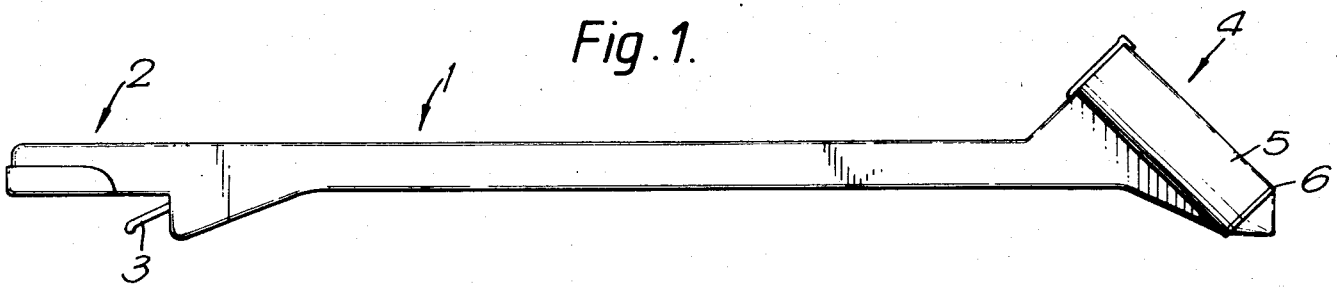
FIG. 1 is an elevation of one form of the apparatus.

Referring first to FIG. 1, the apparatus comprises an elongated member 1 having a handle portion 2 incorporating a trigger 3 and a sprayhead assembly 4 comprising a sleeve 5 in which a cartridge containing the liquid to be sprayed is inserted. The cartridge has a mechanically actuated valve and a nozzle to which a high voltage can be applied. When the cartridge valve is open and a high voltage is applied to the nozzle, the liquid is electrostatically atomised as a spray through an orifice at the lever end of the sprayhead assembly 4. To enhance the spray there is disposed around the sleeve 5, but insulated from the nozzle, an annular conductor 6 constituting a field adjusting electrode e.g. as described in aforementioned U.S. Pat. No. 4,356,528.

The shaft of the elongated member 1 comprises a casing formed by two shell mouldings of an electrically insulating material.

Figure 2:
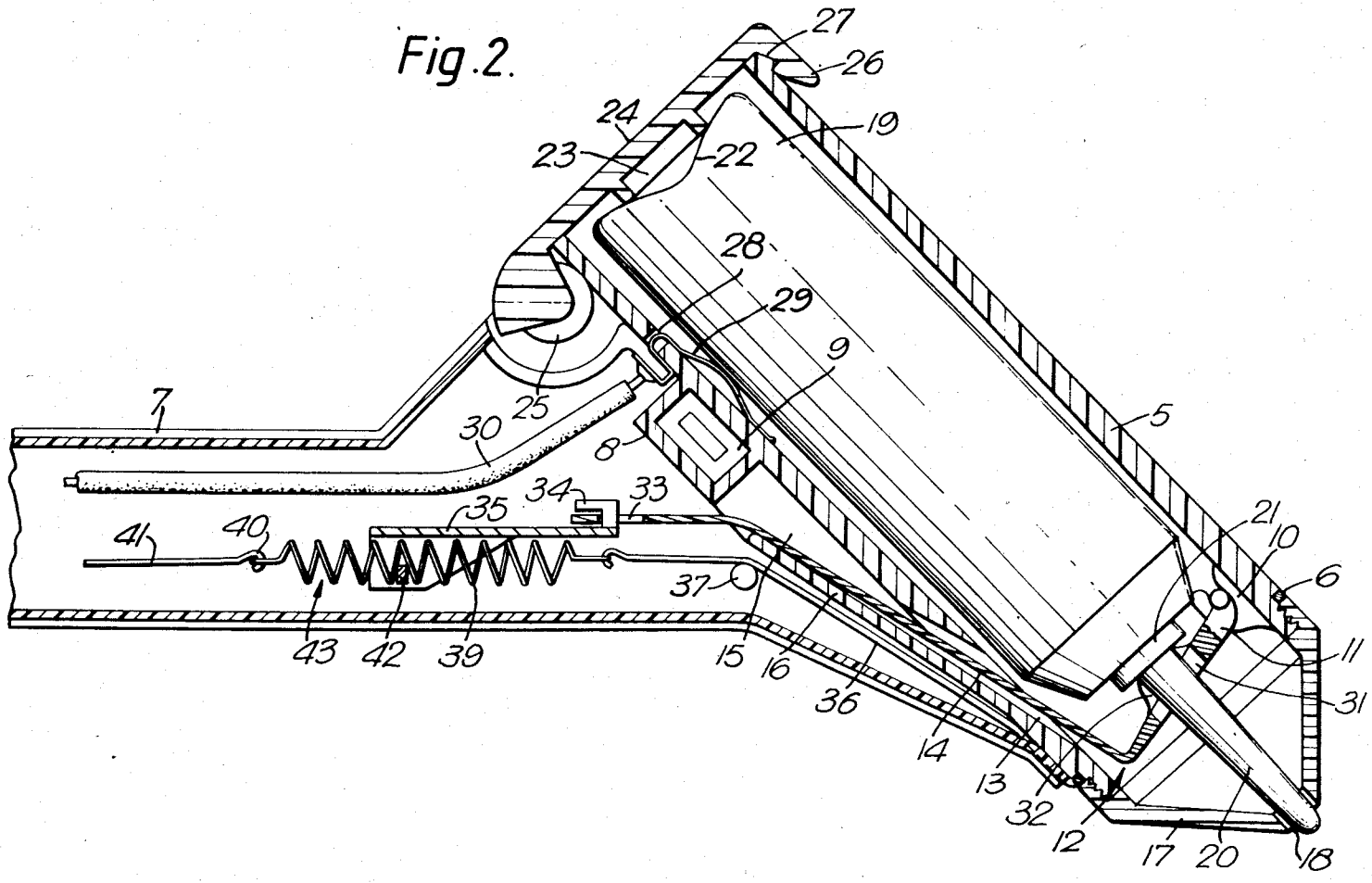
FIG. 2 is a longitudinal section of the sprayhead part of the apparatus.

Referring now to FIG. 2 one of the shell mouldings is indicated by reference numeral 7. The sleeve 5 is moulded from an electrically insulating material and is of generally cylindrical configuration. Sleeve 5 is located on the shell mouldings by means of an integrally moulded, open-sided, box structure 8 which engages with a hollow projection 9 on moulding 7 and a corresponding projection on the other shell moulding. Sleeve 5 is provided with integrally moulded projections 10 in which one end 11 of a valve-actuating member 12 is pivotally mounted.

Sleeve 5 is also provided with an opening 13 through its wall, through which the other end 14 of the valve-actuating member 12 passes, and integral flanges 15, 16 which act as a guide for the end 14 of the valve-actuating member 12.

Screw mounted on the end of the sleeve 5 is a nose cone 17 having an opening 18 through which the end of the cartridge nozzle can project.

The cartridge 19 is a metal can reservoir fitted at one end with a nozzle 20 having a fine bore (not shown) extending longitudinally therethrough. The nozzle 20 is formed integrally with a flange 21 forming part of a valve assembly, typically of the type commonly used in aerosol cannisters. Movement of flange 21 axially towards the base 22 of cartridge 19 effects opening of the valve to permit liquid to flow from the reservoir out of the cartridge via the fine bore extending through nozzle 20.

Cartridge 19 is held in place by a rib 23 on a cap 24 engaging with the base 22 of the cartridge and holding the flange 21 against the valve actuating member 12. The cap 24 is moulded from an electrically insulating plastics material and is pivotally mounted in a boss 25 in shell mould 7 and a corresponding boss in the other shell mould. Cap 24 has an integral latch engaging with a projection 27 moulded integrally with sleeve 5.

Extending through an opening 28 in sleeve 5 is a spring metal contact strip 29 which is held in place between the shell mouldings and the wall of sleeve 5. Electrically connected, e.g. soldered, to strip 29 is a high voltage lead 30 from a generator located in the handle portion of the apparatus. On application of a high voltage to lead 30, the high voltage is applied, via contact strip 29, to the metal can cartridge 19 and hence, via conduction through the cartridge and the liquid therein, to the nozzle 20.

The valve-actuating member 12 is a moulding of an electrically insulating plastics material of such cross section that the portion in the vicinity of nozzle 20, flange 21, and mounting 10 is relatively rigid but the free end 14 is relatively flexible. The valve-actuating member 12 is provided with an opening 31 through which nozzle 20 projects, and projections 32 which engage with flange 21 on either side of nozzle 20. It is then seen that longitudinal movement of the free end 14 of the valve-actuating member 12 away from mounting 10 causes flange 21 to be depressed thus opening the valve. The free end 14 of the valve-actuating member 12 is provided with a slot 33 which engages with a hook-like projection 34 of a saddle member 35.

As mentioned hereinbefore, extending round sleeve 5 is a metal wire 6 acting as a field adjusting electrode. An extension 36 of wire 6 passes through a groove (shown dotted in FIG. 2) in shell moulding 7, round a guide peg 37 formed as a projection in shell moulding 7 and terminates in a hook 38. Engaging with hook 38 is one end of a metal, open coil, tension spring 39. This end of spring 39 is thus anchored by the wire 36 to the sprayhead end of the apparatus. The other end of spring 39 engages with a hook 40 at the end of a wire 41 which extends along the shaft of the elongated member to the trigger 3.

Wire 41, spring 39, and wire 36 thus provide an electrical connection from the trigger 3 to the field adjusting electrode 6 and provide a mechanical connection having an elastically extensible portion from trigger 3.

Saddle 35 is mounted over spring 39 and is provided with a peg 42 that engages between adjacent turns of spring 39, thus completing the mechanical connection from the trigger 3 to the valve-actuating member 12.

It is seen that linear movement of wire 41 away from hook 38 causes extension of the spring 39 and hence linear movement of saddle 35 and hence linear movement of the free end 14 of the valve-actuating member 12 so as to cause the valve to open. Spring 39 provides a return spring action.

Once the valve is fully open, any further movement of wire 41 away from hook 38 causes further extension of that part 43 of spring 39 on the hook 40 side of peg 42, thus enabling the excess of movement of wire 41 to be accommodated with minimum risk of damage to the cartridge valve.

It will be appreciated that manufacturing variations in dimensions, e.g. the length of wires 36 and 41, can be accommodated during assembly by positioning peg 42 between different adjacent turns of spring 39.

Figure 3:
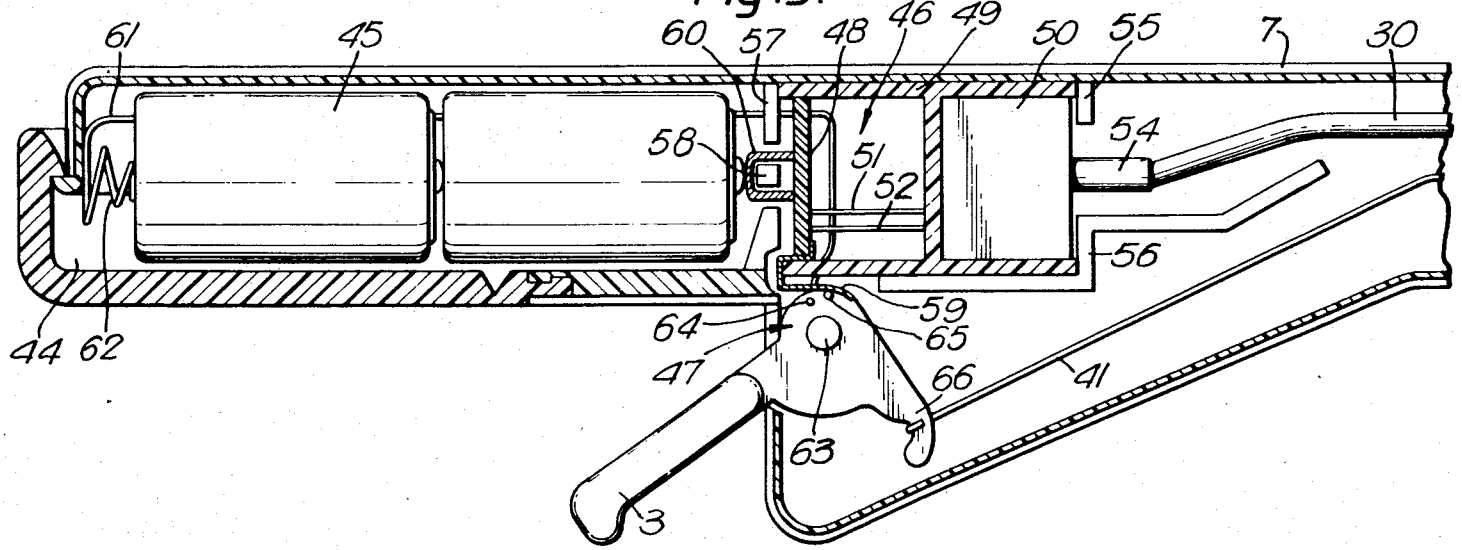
FIG. 3 is a longitudinal section of the handle part of the apparatus.

The handle portion 2 of the apparatus is shown in FIG. 3.

Provided within the handle portion 2 of the casing is a compartment 44 for receipt of a series train of two dry cell batteries 45; a high voltage generator assembly 46; and a trigger assembly 47.

Figure 4:
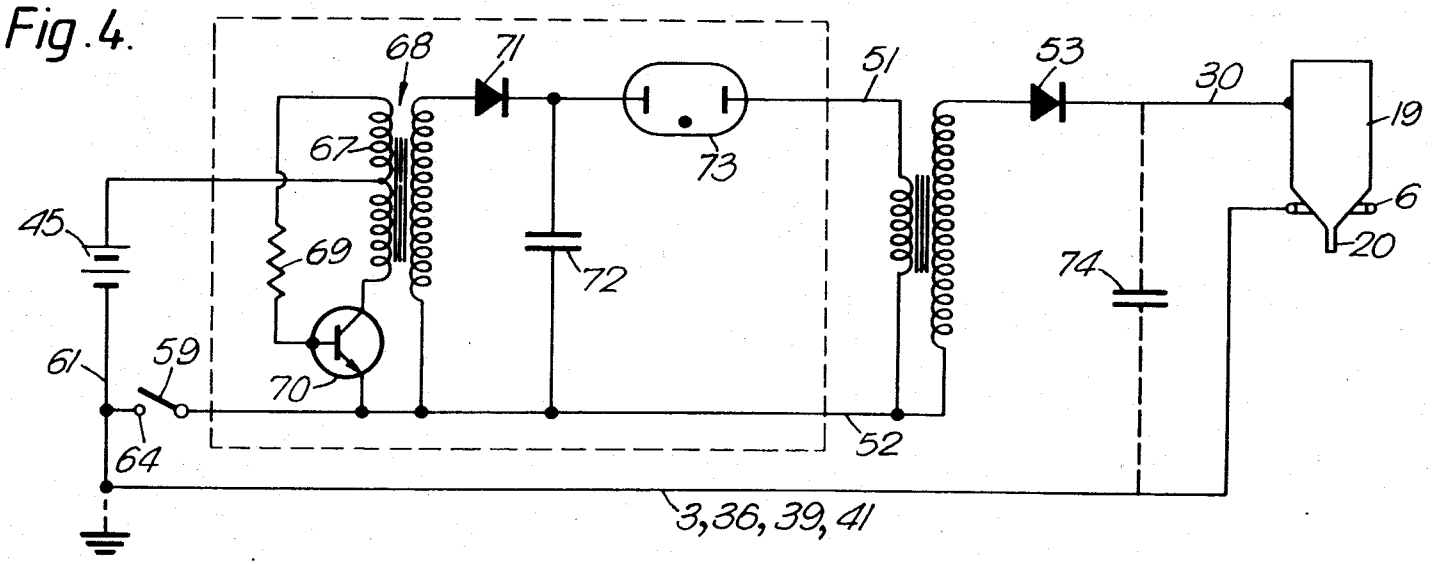
FIG. 4 is a circuit diagram.

The generator assembly comprises a printed circuit board 48 on which are mounted the various components shown in FIG. 4 as enclosed within the dotted box. For simplicity these components are not shown in FIG. 3. Board 48 is mounted in a moulding 49 of electrically insulating plastics material. Also mounted in moulding 49 is an output step-up transformer 50 which is connected to board 48 by leads 51, 52. The high voltage output from transformer 50 is fed, via a high voltage diode 53, to the high voltage lead 30 via a contact within sleeve 54 attached to transformer 50. The generator assembly 46 is located by projections 55, 56, 57 and 58 integral with shell moulding 7 and by corresponding projections (not shown) in the other shell moulding.

Board 48 is provided with two electrical contacts 59, 60. Contact 59 is a spring metal strip which extends round moulding 49 to the trigger assembly 47 while contact 60 projects into the battery compartment 44 wherein it contacts the positive terminal of the train of batteries 45. Extending the length of compartment 44 is a wire 61. At the rear end of compartment 44, wire 61 is formed as a coil spring contact 62 which urges the trains of batteries 45 into engagement with contact 60. Wire 61 also serves to connect the negative contact of the battery train to the trigger assembly 47.

The trigger assembly 47 comprises a trigger lever 3 made of an electrically conductive plastics material pivotably mounted on bosses 63 in the shell mouldings. The free end of wire 61 from the battery compartment extends through a hole in lever 3 to form a contact pin 64. Also mounted in lever 3 is a pin 65 formed from an electrically insulating material. Pin 65 engages with the spring contact strip 59 from board 48 to hold the strip 59 out of engagement with pin 64 when the trigger lever 3 is in the "off" position. Strip contact 59 is laterally spaced from lever 3, and hence insulated therefrom when the trigger is in the "off" position. Rotation of lever 3 from the "off" position causes the contact pin 64 to engage with strip contact 59 thus completing the circuit to supply power from the batteries 45 to the generator.

Hooked round an integral extension 66 to trigger lever 3 is the connecting wire 41.

In use the operator's finger contacting trigger lever 3 provides a connection, through the operator, to earth thus earthing the field intensifying electrode 6 and the negative side of the battery train.

Referring now to FIG. 4, the low voltage part of the high voltage generator circuit consists of a conventional transistorised saturation oscillator formed by the tapped primary 67 of a first step-up transformer 68, resistor 69 and a transistor 70. Typically this oscillator has a frequency of the order of 10 to 100 kHz. The secondary of transformer 68 is connected, via a diode 71, to a capacitor 72. Connected in parallel with capacitor 72 is a gas-gap discharge tube 73 connected in series with the primary of the output step-up transformer 50. Shown dotted in the high voltage output circuit of FIG. 4 is a capacitor 74. This capacitor is not a discrete component but represents the capacitance between the high voltage lead 30, the cartridge 19, and the nozzle 20 and the adjacent "earthed" components, e.g. wires 37, 36 and 41, spring 39 and the field intensifying electrode 6.

In operation the saturation oscillator gives rise to current pulses in the secondary of transformer 68 which charges capacitor 72 via diode 71. When the voltage across capacitor 72 reaches the striking voltage of gas-gap discharge tube 73, the latter conducts discharging capacitor 72 through the primary of output transformer 50, until the voltage across the gas-gap discharge tube falls to the extinguishing voltage. Typically the striking voltage is 150–250 V and the extinguishing voltage is less than 10 V.

The discharge of capacitor 72 through the primary of transformer 50 produces high voltage pulses in the secondary thereof: these high voltage pulses charge capacitor 74 via diode 53 and thus maintain a sufficiently high potential between nozzle 20 and the field intensifying electrode 6 for electrostatic atomisation of the liquid from nozzle 20. In order to maintain a sufficiently high voltage, e.g. 5–20 kV, at nozzle 20, the frequency with which gas-gap discharge tube 73 discharges capacitor 72 is typically 20–50 Hz.

I claim:

1. Electrostatic spraying apparatus incorporating (a) a sprayhead having (i) a nozzle from which the liquid is to be sprayed, (ii) liquid delivery means, incorporating a mechanically operable valve, for supplying liquid from a reservoir to the nozzle, (iii) a valve-actuating member arranged such that linear movement of at least a portion thereof causes said valve to operate, (iv) means for applying a high electric potential, relative to earth, to said nozzle, (b) a manually operable lever remote from said sprayhead, and (c) a mechanical connection between said lever and said valve-actuating member whereby movement of said lever causes the linear movement of said valve-actuating member to effect operation of the valve, said mechanical connection comprising a connecting member anchored at one end to a fixed part of the sprayhead and at the other end engaging with said lever, said connecting member including an elastically extensible portion and said valveactuating member engaging with said connecting member at a position within said elastically extensible portion, and said connecting member being electrically conductive thus providing an electrical connection from said lever to said sprayhead.

2. Apparatus according to claim 1 wherein the elastically extensible portion of the connecting member comprises at least one tension spring.

3. Apparatus according to claim 2 wherein the tension spring is a coil spring and the valve actuating member engages with said connecting member by means of a part passing between adjacent turns of said tension spring.

4. Apparatus according to claim 1 including an elongated member having a handle portion, incorporating the lever, at one end and the spray head at the other end, wherein the means for applying a high potential comprises a connection from a high voltage generator powered by batteries, said batteries being located within said handle portion of said elongated member.

5. Apparatus according to claim 1 wherein the lever is arranged to actuate switch contacts whereby the high potential can be switched on and off by movement of the lever.

6. Apparatus according to claim 5 wherein the switch contacts are positioned such that, on movement of the lever, said contacts make before opening of the valve occurs.

7. Apparatus according to claim 1 wherein the lever is electrically conductive whereby an earth connection is made from the connecting member, via said lever and the operator, when the operator contacts said lever.

8. Apparatus according to claim 7 including an elongated member having a handle portion, incorporating the lever, at one end and the spray head at the other end, wherein the means for applying a high potential comprises a connection from a lead from a high voltage generator located within said handle portion of said elongated member, said lead being insulated from the connecting member.

9. Apparatus according to claim 7 wherein an electrode is disposed adjacent to, but insulated from the nozzle, and the connecting member provides the electrical connection to said electrode.

* * * * *